US008944827B2

(12) United States Patent
Ohsaka

(10) Patent No.: US 8,944,827 B2
(45) Date of Patent: Feb. 3, 2015

(54) COAXIAL ELECTRICAL CONNECTOR AND COAXIAL ELECTRICAL CONNECTOR DEVICE

(71) Applicant: Dai-Ichi Seiko Co., Ltd., Kyoto-shi (JP)

(72) Inventor: Junji Ohsaka, Tokyo (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 52 days.

(21) Appl. No.: 13/764,178

(22) Filed: Feb. 11, 2013

(65) Prior Publication Data

US 2013/0244486 A1 Sep. 19, 2013

(30) Foreign Application Priority Data

Mar. 13, 2012 (JP) ..... 2012-055338

(51) Int. Cl.

| | |
|---|---|
| ***H01R 12/00*** | (2006.01) |
| ***H01R 13/60*** | (2006.01) |
| ***H01R 12/57*** | (2011.01) |
| ***H01R 24/50*** | (2011.01) |
| *H01R 103/00* | (2006.01) |
| *H01R 12/70* | (2011.01) |

(52) U.S. Cl.

CPC ..... *H01R 13/60* (2013.01); *H01R 12/57* (2013.01); *H01R 24/50* (2013.01); *H01R 2103/00* (2013.01); *H01R 12/7082* (2013.01)

USPC ..... 439/63; 439/581

(58) Field of Classification Search

USPC ..... 439/581, 63

See application file for complete search history.

(56) References Cited

U.S. PATENT DOCUMENTS

| | | | | |
|---|---|---|---|---|
| 8,262,398 | B2 * | 9/2012 | Chen | 439/188 |
| 8,657,608 | B2 * | 2/2014 | Tsai et al. | 439/63 |
| 2004/0106304 | A1 * | 6/2004 | Lin et al. | 439/63 |
| 2004/0137764 | A1 * | 7/2004 | Yamane | 439/63 |
| 2006/0024985 | A1 * | 2/2006 | Nagata et al. | 439/63 |
| 2006/0128172 | A1 * | 6/2006 | Chien et al. | 439/63 |
| 2007/0004238 | A1 * | 1/2007 | Breinlinger et al. | 439/63 |
| 2009/0093138 | A1 * | 4/2009 | Benham et al. | 439/63 |
| 2009/0149063 | A1 | 6/2009 | Yotsutani | |
| 2009/0166087 | A1 | 7/2009 | Braden et al. | |
| 2009/0197432 | A1 * | 8/2009 | Li | 439/63 |

(Continued)

FOREIGN PATENT DOCUMENTS

| | | |
|---|---|---|
| JP | 2003-297491 | 10/2003 |
| JP | 2004-63372 | 2/2004 |

(Continued)

*Primary Examiner* — Gary Paumen

(74) *Attorney, Agent, or Firm* — Oblon, Spivak, McClelland, Maier & Neustadt, L.L.P.

(57) ABSTRACT

A guiding function of an annular contact upon mating/removal with/from an opposing connector can be maintained well with a simple configuration. An annular contact is formed with an unruptured annular member having no ruptured part in a circumferential direction and continued in the circumferential direction. As a result, compared with a conventional annular contact having ruptured parts in the circumferential direction, rigidity is increased while maintaining necessary elasticity; and, for example even when an opposing connector is mated or removed in a direction inclined in an axial direction with respect to the axial direction of the annular shape, conventional twisting deformation is suppressed in the annular contact, and the opposing connector is stably guided along the axial direction of the annular shape, thereby well maintaining a mating guiding function of the annular contact.

3 Claims, 8 Drawing Sheets

(56) References Cited

U.S. PATENT DOCUMENTS

| | | | | |
|---|---|---|---|---|
| 2010/0248503 | A1* | 9/2010 | Kang et al. | 439/63 |
| 2010/0304579 | A1* | 12/2010 | Kisling | 439/63 |
| 2011/0159708 | A1* | 6/2011 | Huang et al. | 439/63 |
| 2011/0217853 | A1* | 9/2011 | Cornic et al. | 439/63 |

FOREIGN PATENT DOCUMENTS

| | | | |
|---|---|---|---|
| JP | 2009-140687 | A | 6/2009 |
| JP | 2012-28210 | | 2/2012 |
| KR | 1020110089450 | | 8/2011 |
| WO | WO 2011/013747 | A1 | 2/2011 |

* cited by examiner

COAXIAL ELECTRICAL CONNECTOR AND COAXIAL ELECTRICAL CONNECTOR DEVICE

BACKGROUND OF THE INVENTION

1. Field of the Invention

The present invention relates to a coaxial electrical connector and a coaxial electrical connector device in which an annular contact, which is formed to have an annular shape, is configured to be elastically displaced via slits upon mating of an opposing connector.

2. Description of Related Art

Generally, in various electric devices, electrically connecting various signal transmission media such as thin coaxial cables and flexible wiring boards to printed wiring boards or electrically connecting a pair of wiring boards to each other (board to board) by using a pair of electrical connectors, which are configured to be able to be mated and connected with each other, has been widely carried out. As the pair of electrical connector as described above, for example, a plug connector (first connector), to which a signal transmission medium or a wiring board is coupled, and a receptacle connector (second connector), which is mounted on a wiring board, are used as described in Japanese Patent Application Laid-Open No. 2004-063372. The electrical connection is configured to be established when the plug connector is mated with the receptacle connector.

As an electrical connector used in the connection of the above described pair of wiring boards (board to board), a coaxial electrical connector in which a signal contact and a ground contact are concentrically disposed is known. In the coaxial electrical connector, an annular contact in which slits (ruptured parts) are partially provided in the circumferential direction thereof is used, and an opposing connector is configured to be mated or removed through an annular opening of the annular contact. The mating or removal of the opposing connector in that process is carried out along the axial direction of the annular opening. In that process, elastic displacement occurs so as to expand the intervals between the slits (ruptured parts) of the annular contact, the outer diameter of the annular contact is increased as a result. At the point when the mating operation or the removing operation is completed, the annular contact is restored to the original position, thereby maintaining the connectors in a mated state or a releases state.

In this process, the annular contact has a mating guiding function of maintaining the opposing connector in an appropriate position until the mating or removal is completed after the opposing connector abuts the annular contact. However, in the conventional coaxial electrical connector, the slits are provided as the ruptured parts in the annular contact as described above. Therefore, there is a tendency that the overall rigidity of the annular contact is reduced. For example, when the opposing connector is mated or removed in a direction inclined in an axial direction with respect to the annular opening of the annular contact, twisting deformation may be generated in the annular contact. As a result, the mating guiding function of the annular contact with respect to the opposing connector is lowered, smooth mating or removing operation cannot be carried out, or connector damage is caused in some cases. Particularly, when a board is to be connected to a board with the electrical connector, the opposing connector of mating is sometimes covered with the board and cannot be visually checked; therefore, the mating guiding function of the annular contact is important.

We disclose JP 2004-063372 (A) as a prior art that is considered to represent the most relevant state of the art.

BRIEF SUMMARY OF THE INVENTION

It is an object of the present invention to provide a coaxial electrical connector and a coaxial electrical connector device configured so that the guiding function of an annular contact upon mating/removal of an opposing connector is maintained well with a simple configuration.

An electrical connector according to the present invention for achieving the above described object has an annular contact formed so as to have an annular shape, the coaxial electrical connector configured so that an opposing connector is mated or removed therewith/therefrom along an axial direction of an annular opening through the annular opening formed in the annular contact; wherein a configuration that the annular contact is formed of an unruptured annular member integrally continued in a circumferential direction is employed.

According to the coaxial electrical connector having such a configuration, the entire annular contact has an unruptured integrated structure. Therefore, compared with the conventional annular contact having the ruptured parts in the circumferential direction, rigidity is increased while maintaining necessary elasticity. For example, even when the opposing connector is mated or removed in a direction inclined in an axial direction with respect to the axial direction of the annular shape, conventional twisting deformation is suppressed in the annular contact. As a result, the mating guiding function of the annular contact is maintained well, and the opposing connector is therefore stably guided along the axial direction of the annular shape.

In the present invention, it is desired that the annular opening of the annular contact be formed so as to extend in a curved shape toward an inner side or an outer side in a radial direction of the annular opening.

According to the coaxial electrical connector having such a configuration, upon mating/removal of the opposing connector, the opposing connector is smoothly moved along the curved surface provided at the annular opening of the annular contact, and the mating guiding function of the annular contact is further improved.

It is desired that a plurality of through holes be formed in the annular contact of the present invention at an approximately equal interval in the circumferential direction.

According to the coaxial electrical connector having such a configuration, stress generated in the annular contact upon mating/removal of the opposing connector is dispersed to the entire annular contact via the through holes, and usage durability of the annular contact is enhanced.

A coaxial electrical connector device of the present invention is comprised of the above described coaxial electrical connector and a printed wiring board on which the coaxial electrical connector is mounted, wherein the device employs a configuration in which: the annular contact of the coaxial electrical connector is a ground contact; a signal contact is disposed in an inner side in a radial direction of the ground contact; an electrically-conductive ground path to be connected to the ground contact and an electrically-conductive signal path to be connected to the signal contact are formed on the printed wiring board; and the electrically-conductive signal path is formed in a center region of the radial direction of the ground contact.

According to the coaxial electrical connector device having such a configuration, electrical connection of the signal contact is established at the center part of the ground contact. Therefore, positioning about the connection of the signal contact becomes unnecessary in the circumferential direction of the ground contact. As a result, even when the entire connector is rotated about the axis of the ground contact upon mounting to the wiring board, the mounting operation can be continued since there is almost no positional misalignment of the signal contact, mounting errors are reduced, and a so-called production yield is therefore improved. Moreover, since a member that insulates the upper side of the connection leg part of the signal contact like conventional cases becomes unnecessary, the height of the connector can be reduced, and the electromagnetic shielding characteristic (EMI characteristic) with respect to the signal transmission path is improved since an outer-peripheral-side part of the signal transmission path including the signal contact is covered with the ground contact.

As described above, the coaxial electrical connector and the coaxial electrical connector device according to the present invention increase rigidity while maintaining necessary elasticity compared with the conventional annular contact, which has the ruptured parts in the circumferential direction, by forming the annular contact by the unruptured annular member having no ruptured part in the circumferential direction and continued in the circumferential direction. For example when the opposing connector is mated or removed in a direction inclined in the axial direction with respect to the axial direction of the annular shape, twisting deformation in the annular contact is suppressed, and the opposing connector is stably guided along the axial direction of the annular shape so as to configure that the mating guiding function of the annular contact is maintained well. Therefore, the guiding function of the annular contact upon mating/removal with/from the opposing connector can be maintained well, and reliability of the coaxial electrical connector and the coaxial electrical connector device can be significantly enhanced with low cost.

BRIEF DESCRIPTION OF THE DRAWINGS

FIG. 5 is mated with the opposing connector;

DETAILED DESCRIPTION OF THE INVENTION

Hereinafter, an embodiment in which the present invention is applied to coaxial electrical connectors which mutually connect printed wiring boards and a coaxial electrical connector device will be explained in detail based on drawings.

[About Overall Structure]

Figure 1:
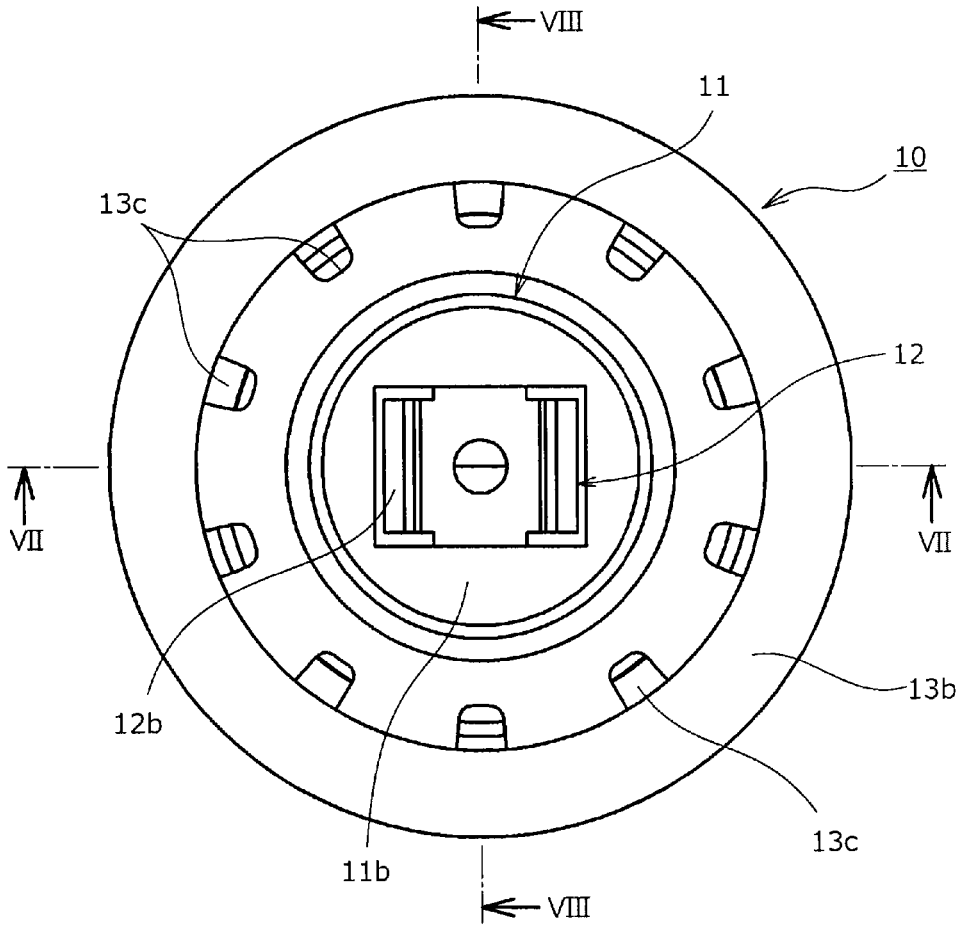
FIG. 1 is an explanatory plan view showing the structure of a coaxial electrical connector according to an embodiment of the present invention.
Figure 2:
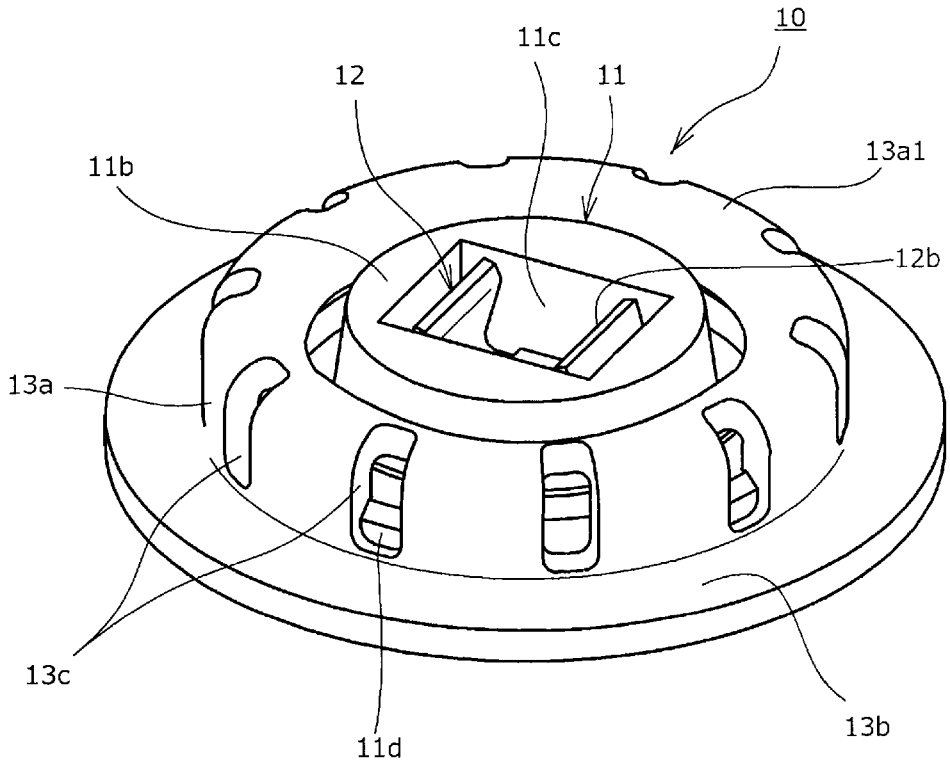
FIG. 2 is an explanatory external perspective view showing, from the upper side, the coaxial electrical connector according to the embodiment of the present invention shown in FIG. 1.
Figure 3:
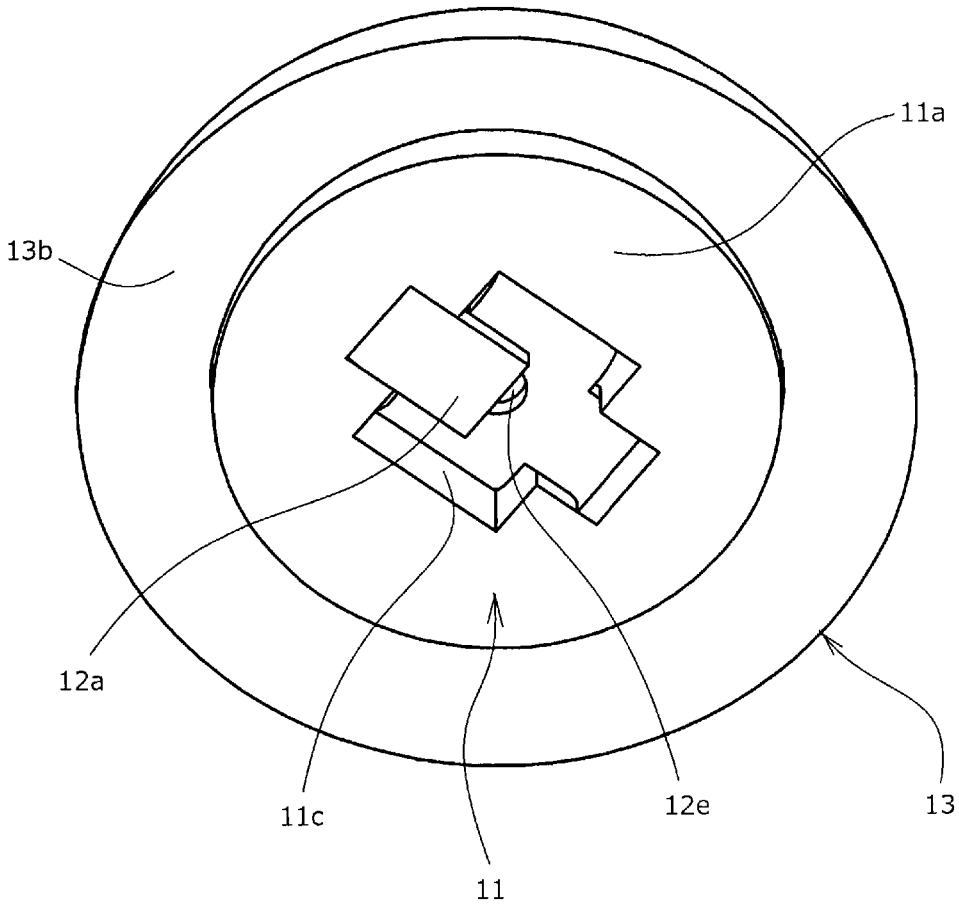
FIG. 3 is an explanatory external perspective view showing, from the lower side, the coaxial electrical connector according to the embodiment of the present invention shown in FIG. 1 and FIG. 2.
Figure 4:
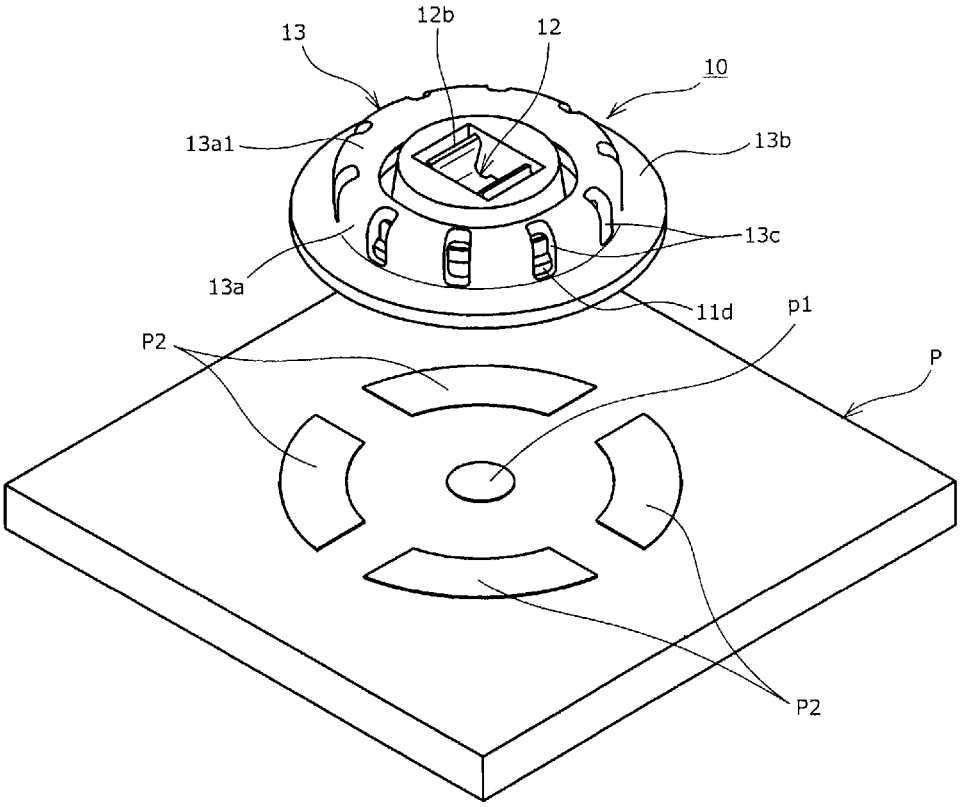
FIG. 4 is an explanatory external perspective view showing, from the upper side, a state immediately before the coaxial electrical connector according to the embodiment of the present invention shown in FIG. 1 to FIG. 3 is mounted on a printed wiring board.
Figure 5:
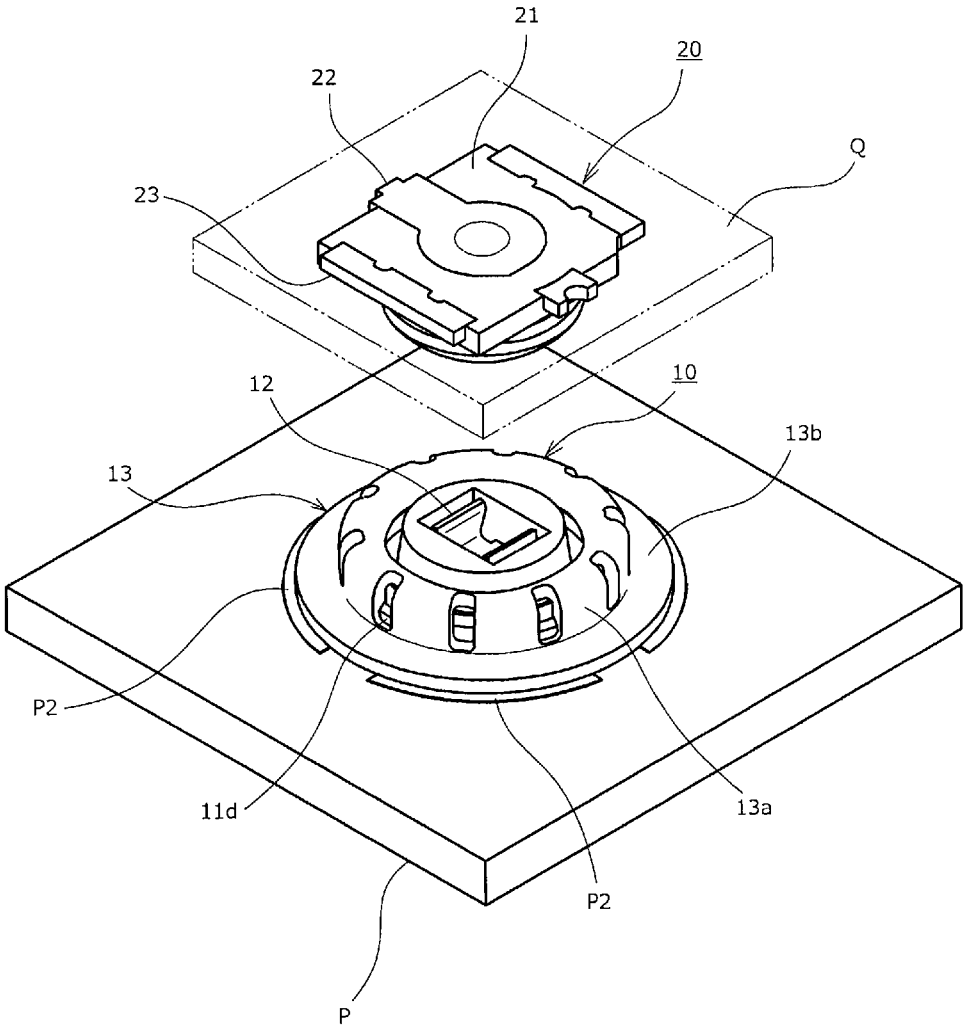
FIG. 5 is an explanatory external perspective view showing, from the upper side, a state immediately before a coaxial electrical connector device according to the embodiment of the present invention shown in FIG. 4 is mated with an opposing connector.
Figure 6:
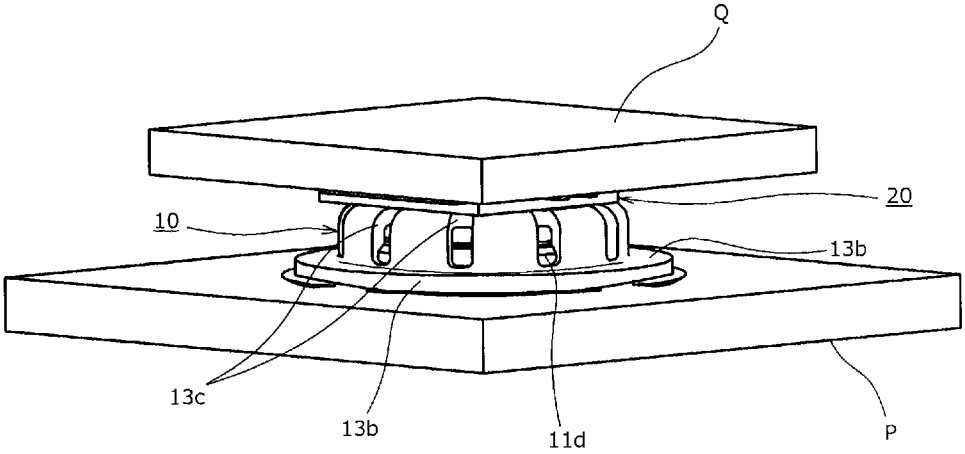
FIG. 6 is an explanatory external perspective view showing, from the upper side, a mating completed state after the coaxial electrical connector device according to the embodiment of the present invention shown in FIG. 4

A coaxial electrical connector device using a coaxial electrical connector 10 according to an embodiment of the present invention shown in FIG. 1 to FIG. 9 is, for example, mounted by soldering on a printed wiring board P disposed on an electronic device such as a mobile phone, and, in the upper side of the coaxial electrical connector 10, another coaxial electrical connector 20 serving as an opposing connector is, for example, coaxially disposed while being held by a hand of an operator (see FIG. 5). When the coaxial electrical connector 20 is thrust in toward the coaxial electrical connector 10 therebelow with appropriate force, both of the connectors 10 and 20 are caused to be in a mutually mated state. When the coaxial electrical connector (opposing connector) 20 is held and pulled up to the upper side with appropriate force from the mated state of both of the connectors 10 and 20, removal is carried out so that the coaxial electrical connector 20 of the opposing side is detached to the upper side from the coaxial electrical connector 10 according to the embodiment of the present invention.

The above described inserting/removing operation of the coaxial electrical connector (opposing connector) 20 is not limited to be carried out by the hand of the operator, but may be automatically carried out by a machine. Hereinafter, the inserting direction and the removing direction of the coaxial electrical connector 20 will be referred to as a "downward direction" and an "upward direction", respectively.

[About Configuration of Insulating Housing]

An insulating housing 11 constituting a main body part of the coaxial electrical connector 10 has been, for example, formed by molding by using a resin material such as plastic; and the insulating housing 11 integrally has a base frame body 11*a*, which is placed on the printed wiring board P, and a center frame body 11*b*, which consists of a hollow body projecting upward from a center-side part of the base frame body 11*a*. Among them, the center frame body 11*b* is formed so as to form part of a conical shape of which outer diameter is continuously reduced from the upper surface of the base frame body 11*a* to the upper side, and a hollow contact insertion path 11*c* forming an approximately rectangular shape in a plane is formed in an inner-side part of the center frame body 11*b* so as to penetrate therethrough in the vertical direction. A later-described signal contact 12 for signal transmission is attached to the interior of the contact insertion path 11*c* so as to be inserted therein from the lower side.

Fixing pieces 11*d* (see FIG. 8) are formed on an outer-periphery-side end face of the base frame body 11*a* so as to project to the outer side. When later-described through holes 13*c* provided in a ground contact 13, which constitutes an annular contact and is for grounding, are engaged with the fixing pieces 11*d*, the entire ground contact 13 is fixed. The ground contact 13 serving as the annular contact is attached so as to surround the center frame body 11*b* from the outer side in the radial direction thereof. The structure of the ground contact 13 will be explained later in detail.

[About Configuration of Signal Contact]

The signal contact 12 is formed of a bent member of a predetermined thin metal plate and has a connection leg part 12*a* solder-joined with an electrically-conductive signal path P1, which is formed on the printed wiring board P. Particularly as shown in FIG. 4, the electrically-conductive signal path P1 of this case is formed so as to be exposed while forming a circular shape at an approximately center position of the region to which the coaxial electrical connector 10 is mounted, and the electrically-conductive signal path P1 is in an arrangement relation so that the connection leg part 12*a* of the signal contact 12 is brought into contact with the circular electrically-conductive signal path P1 from the upper side.

Figure 8:
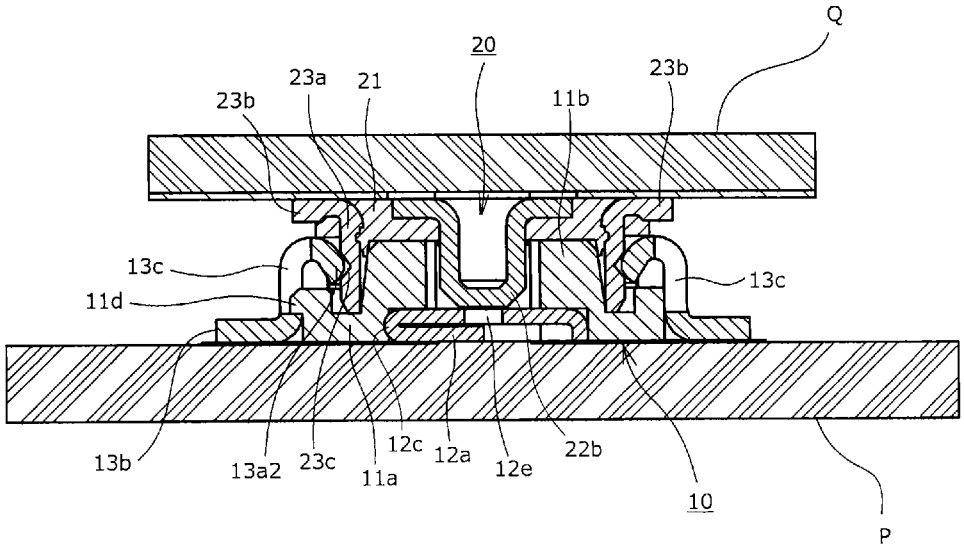
FIG. 8 is an explanatory vertical cross sectional view taken along a line VIII-VIII in FIG. 1.
Figure 9:
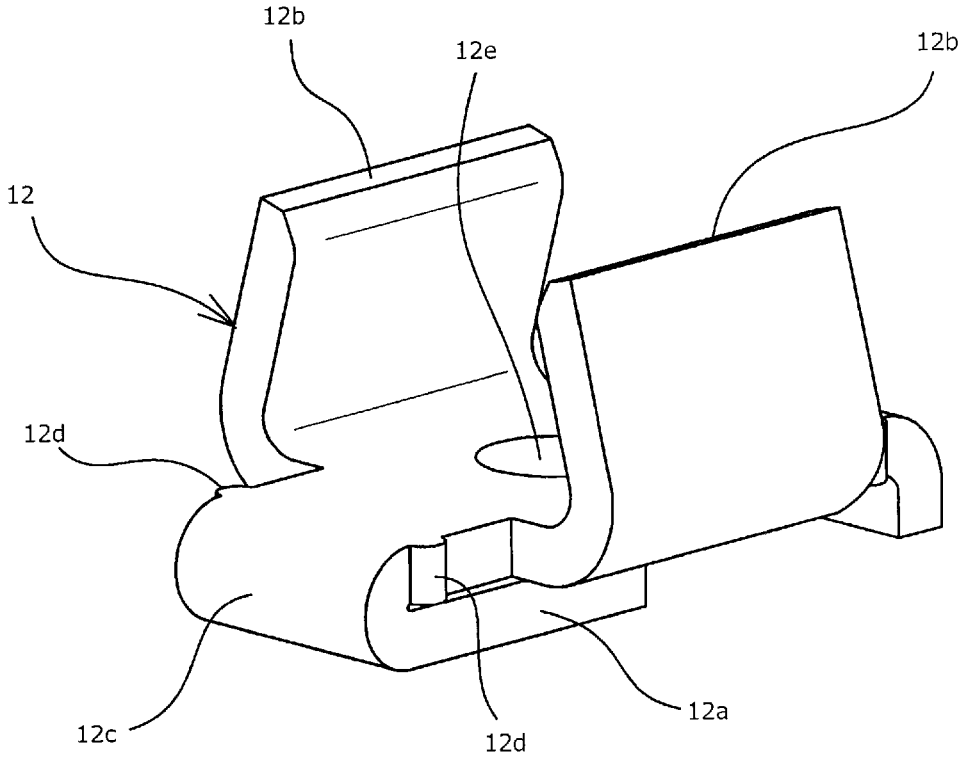
FIG. 9 is an explanatory external perspective view showing, from the upper side, a signal contact used in the coaxial electrical connector shown in FIG. 1 to FIG. 3.

Particularly as shown in FIG. 9, the connection leg part 12*a* of the signal contact 12 is formed of a flat-plate-like member extending along the surface of the printed wiring board P, and a mating contact part 12*b*, which is formed so as to form an approximately U-shape in a lateral plane (see FIG. 7), is provided at a position immediately above the connection leg part 12*a*. The mating contact part 12*b* is formed so as to form, in a vertical section, an approximately trapezoidal shape having an upward opening, and both of the members 12*a* and 12*b* are integrally continued to each other via a curved coupling part 12*c*, which is bent and extending so as to be reversed from a first-end edge part of the above described connection leg part 12*a* to the upper side. The mating contact part 12*b* of the signal contact 12 is configured to be mated with and contact a later-described mating contact part 22*b* of a signal contact 22, which is provided in the coaxial electrical connector 20 serving as the opposing connector, so as to cover that part from the outer side (see FIG. 7 and FIG. 8).

In this case, paired fixing pieces 12*d* and 12*d* are formed at both lateral edges of the above described curved coupling part 12*c* in the plate width direction thereof so that each of the fixing pieces is projecting to the outer side. When the fixing pieces 12*d* are engaged with part of the base frame body 11*a* of the insulating housing 11, the entire signal contact 12 is fixed.

A bottom surface part of the above described mating contact part 12*b* is formed so as to be extended approximately in parallel at a position above the connection leg part 12*a*, and a connection check hole 12*e* is formed in a bottom surface part of the mating contact part 12*b*. The connection check hole 12*e* is formed so as to penetrate through the bottom surface part of the mating connection part 12*b* in the vertical direction; wherein an edge part of the connection leg part 12*a* below is configured to be visually checkable through an approximately semicircular part of the connection check hole 12*e*, and the upper surface of the printed wiring board P below is configured to be visually checkable through the other approximately semicircular part. Therefore, whether the connection leg part 12*a* is disposed at a predetermined position with respect to the electrically-conductive signal path P1 of the printed wiring board P or not can be directly checked by the eyes of the operator by visual check from the upper side using the connection check hole 12*e*.

[About Configuration of Ground Contact]

On the other hand, the ground contact 13, which is the annular contact in the present invention, is formed by die/punch pressing of a predetermined thin metal plate and has a ground main-body part 13*a*, which is formed so as to form an approximately cylindrical hollow shape, and a connection leg part 13*b*, which is integrally extending from an outer-periphery lower edge part of the ground main-body part 13*a* to the outer side in the radial direction thereof. Among them, the connection leg part 13*b* forms a flange-plate shape extending to have a constant width over the entire circumference and is configured to be placed on and solder-joined with a plurality of (four) electrically-conductive ground paths P2, which are formed so as to form arch shapes on the printed wiring board P. Since the ground contact 13 is manufactured by die/punch pressing, the pitches between products can be reduced, and manufacturing cost can be reduced.

The ground main-body part 13*a* is composed of an electrically-conductive member, which is integrally continued in the circumferential direction thereof, and is formed of an unruptured annular member not having conventional slits (ruptured parts). The ground main-body part 13*a* is formed so as to be bent and rise upward at an approximately right angle from an inner peripheral edge part of the above described connection leg part 13*b*, and the coaxial electrical connector 20 serving as the opposing connector is configured to be mated or removed through an annular opening formed at an upper end part of the ground main-body part 13*a*.

As described above, the ground contact 13 is formed so as to form a continuous annular shape, and no slit (ruptured part) that divides the ground main-body part 13*a* in the circumferential direction like conventional cases is formed. However, the ground contact 13 is configured so that elastic displacement is carried out in the circumferential direction and the radial direction thereof in the state in which the entire ground contact 13 is integrated.

In this case, an upper-edge annular part 13*a*1, which forms the annular opening of the ground main-body part 13*a*, is formed so as to extend in a curved shape from an upper end part of the ground main-body part 13*a* toward the inner side in the radial direction thereof. More specifically, the upper-edge annular part 13*a*1 is formed so that a vertical cross sectional shape thereof in the radial direction forms an approximately arc shape, and the part 13*a*1 extends so as to be curved obliquely upward in an approximately arc shape toward the inner side in the radial direction from the upper end part of the ground main-body part 13*a* and then extends so as to form a continued approximately arc-shaped curve shape obliquely downward further toward the inner side in the radial direction from a vertex part of the approximate arc shape.

An inner-side distal end part of the upper-edge annular part 13*a*1 like this is projecting obliquely downward toward the center side of the coaxial electrical connector 10 so as to form a hook shape, and the inner-side distal end part of the upper-edge annular part 13*a*1 is formed to be an annular latching part 13*a*2. The annular latching part 13*a*2 is elastically engaged with an annular engaging part 23*c* provided in the later-described other coaxial electrical connector 20 serving as the opposing connector (see FIG. 7 and FIG. 8).

The plurality of through holes 13*c* are formed at an approximately equal interval in the circumferential direction in the ground main-body part 13*a* of the ground contact 13 having the above described configuration. Each of these through holes 13*c* is formed so as to form a long-hole shape extending to be narrow and long upward from a lower edge part of the ground main-body part 13*a*, and the through hole 13*c* is extending to a part in the vicinity of the vertex part of the above described upper-edge annular part 13*a*1.

The later-described other coaxial electrical connector 20 serving as the opposing connector is to be mated with or removed from the coaxial electrical connector 10 having such a configuration. When mating is to be carried out, a ground main-body part 23*a* of the other coaxial electrical connector (opposing connector) 20 abuts, from the upper side, the upper-edge annular part 13*a*1 of the ground main-body part 13*a*, which constitutes the above described ground contact 13, and the coaxial electrical connector 20 is inserted to the inner side along the curved surface of the upper-edge annular part 13*a*1 of the coaxial electrical connector 10. As a result, the inner-diameter part of the ground main-body part 13*a* is elastically deformed so as to be pushed and expanded outward, and the ground main-body part 13*a* is displaced in the circumferential direction and the radial direction thereof. Furthermore, when the mating operation of the other coaxial electrical connector 20 is completed, the ground main-body part 13*a* is restored in a direction that the ground main-body part 13*a* shrinks in the circumferential direction and the radial direction. In an operation of removing the other coaxial electrical connector 20 from the coaxial electrical connector 10, the above described elastic displacement is carried out in the opposite direction.

[Overall Configuration of Opposing Connector]

Figure 7:
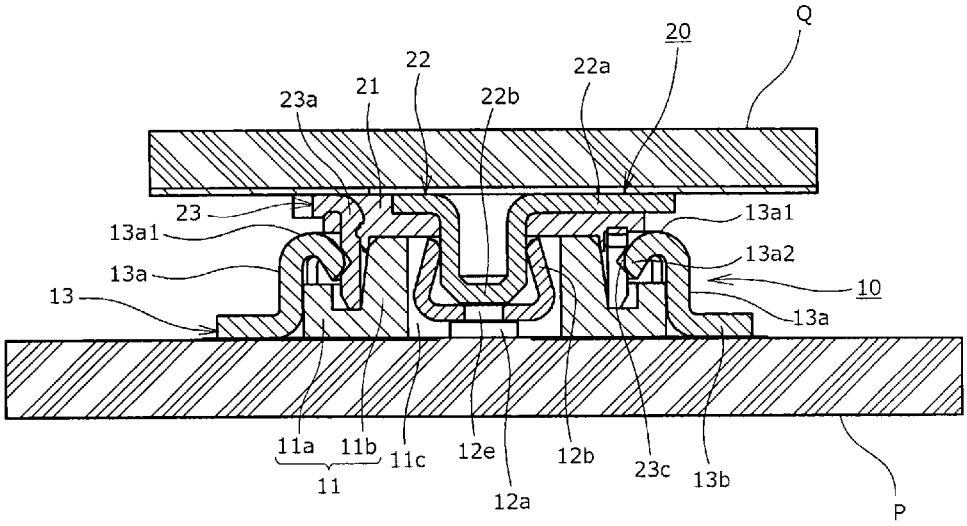
FIG. 7 is an explanatory vertical cross sectional view taken along a line VII-VII in FIG. 1.

As described above, the other coaxial electrical connector 20 serving as the opposing connector is configured to be mated, from the upper side, with the coaxial electrical connector 10 according to the embodiment of the present invention or removed therefrom toward the upper side particularly as shown in FIG. 7 and FIG. 8. The other coaxial electrical connector (opposing connector) 20 in this case also has an approximately similar configuration. Therefore, members having similar configurations are shown with "1" in the tens digit thereof having been replaced by "2", and different configurations will be explained below.

First, an insulating housing 21 provided in the other coaxial electrical connector (opposing connector) 20 is formed of a flat-plate-like member forming an approximately rectangular shape in a plane, and the signal contact 22 for signal transmission is attached to a center part of the insulating housing 21. A ground contact 23 for grounding is attached so as to surround the signal contact 22 from the outer side.

[About Configuration of Signal Contact]

The signal contact 22 is formed by die/punch pressing of a predetermined thin metal plate and has a connection leg part 22*a* solder-joined with an electrically-conductive signal path (illustration omitted) formed on a printed wiring board Q. The connection leg part 22*a* is extending to the center side of the insulating housing 21 and is integrally continued to the mating contact part 22*b*, which has a hollow pin shape projecting so as to rise upward in an approximately perpendicular direction from the center part thereof. The mating contact part 22*b* is configured to be mated with the inner side of the mating contact part 12*b* provided in the above described coaxial electrical connector 10 according to the present invention (see FIG. 7 and FIG. 8).

[About Configuration of Ground Contact]

The ground contact 23 provided in the other coaxial electrical connector (opposing connector) 20 is also formed of a bent member of a predetermined thin metal plate, wherein a plurality of connection leg parts 23*b* integrally extending toward the radial outer side from the outer peripheral part of the ground main-body part 23*a*, which is formed so as to have an approximately cylindrical hollow shape, are solder-joined with electrically-conductive ground paths (illustration omitted) formed on the printed wiring board Q. The annular engaging part 23*c* consisting of an annular groove is formed at an outer-periphery lower edge part of the ground main-body part 23*a*. The annular engaging part 23*c* is inserted to the radial-direction inner side of the annular etching part 13*a*2 of the above described coaxial electrical connector 10 according to the present invention and caused to be in an elastically mated state (see FIG. 7 and FIG. 8).

The other coaxial electrical connector 20 serving as the opposing connector is disposed so as to face the above described coaxial electrical connector 10 according to the embodiment of the present invention from the upper side in a state in which the connector is reversed to be downward as shown in FIG. 7 and FIG. 8, and mating is then carried out by thrusting in the connector downward. In the mating operation, a distal-end edge part (lower-end edge part) of the ground main-body part 23*a* of the other coaxial electrical connector 20 abuts the upper-edge annular part 13*a*1 of the coaxial electrical connector 10, the ground main-body part 23*a* of the coaxial electrical connector (opposing connector) 20 is inserted to the inner side of the coaxial electrical connector 10 by a guiding action of the curved surface of the upper-edge annular part 13*a*1, and, in this process, the ground main-body part 13*a* of the coaxial electrical connector 10 undergoes elastic deformation in the direction that the ground main-body part 13*a* of the coaxial electrical connector 10 is expanded in the circumferential direction. The elastic deformation of the ground main-body part 13*a* in this process is carried out under approximately uniform circumferential stress based on the elasticity possessed by the entire ground main-body part 13*a*, and mating with respect to the coaxial electrical connector 20 is carried out.

When the mating operation of both of the connectors 10 and 20 is completed, the annular engaging part 23*c* of the other coaxial electrical connector (opposing connector) 20 is mated with the annular latching part 13*a*2 provided in the coaxial electrical connector 10, and the ground main-body part 13*a* provided in the coaxial electrical connector 10 is restored in the direction that the part shrinks in the circumferential direction. In removal of the coaxial electrical connector 10, elastic displacement in the direction opposite to that in the above described step is carried out.

In this manner, in the present embodiment, when the mating operation or removing operation with the other coaxial electrical connector (opposing connector) 20 is carried out, the ground contact 13 serving as the annular contact 13 in the coaxial electrical connector 10 undergoes elastic displacement under the elastic force possessed by the entire ground contact 13. More specifically, the entirety of the ground contact 13 provided in the coaxial electrical connector 10 has an integrated structure; therefore, rigidity has been increased while maintaining the elasticity required for mating/removal compared with a conventional annular contact having slits (ruptured parts) in the circumferential direction. Therefore, even when the other coaxial electrical connector (opposing connector) 20 is mated or removed, for example, in a direction that is inclined with respect to the axial direction of the annular shape, conventional twisting deformation is suppressed in the ground contact 13 of the coaxial electrical connector 10. As a result, the mating guiding function of the ground contact 13 is maintained well, and the other coaxial electrical connector (opposing connector) 20 is configured to be stably guided along the axial direction of the annular shape.

Particularly, in the present embodiment, the upper-edge annular part 13*a*1 forming the annular opening of the ground contact 13 is extending so as to form a curved surface toward the inner side in the radial direction of the annular shape. Therefore, upon mating/removal of the other coaxial electrical connector (opposing connector) 20, the other coaxial electrical connector (opposing connector) 20 is smoothly moved along the curved surface of the upper-edge annular part 13*a*1 of the ground contact 13, and the mating guiding function of the ground contact 13 is further enhanced.

Moreover, the plurality of through holes 13*c* are formed at an approximately equal interval in the circumferential direction in the ground contact 13 in the present embodiment. Therefore, the stress generated in the ground contact 13 upon mating/removal of the other coaxial electrical connector (opposing connector) 20 is dispersed to the entirety of the ground contact 13 via the through holes 13*c*, and usage durability of the ground contact 13 is improved.

Furthermore, in the present embodiment, the electrically-conductive signal path P1 formed on the printed wiring board P is formed in the center region of the radial direction of the ground contact 13. Therefore, electrical connection of the signal contact 12 is carried out at the center part of the ground contact 13. Therefore, positioning about connection of the signal contact 12 is not required in the circumferential direction of the ground contact 13. As a result, even when the entire connector is rotated by some degree about the axis of the ground contact 13 upon mounting to the printed wiring board P, the mounting operation can be continued since there is almost no positional misalignment of the signal contact 12, and, since mounting errors are reduced, so-called production yields is improved.

A member that insulates the upper part of the connection leg part of the signal contact like conventional cases becomes unnecessary. Therefore, the height of the connector can be reduced, and the outer-peripheral-side part of the signal transmission path including the signal contact 12 is covered with the ground contact 13; therefore, the electromagnetic shielding characteristic (EMI characteristic) with respect to the signal transmission path is improved.

The invention accomplished by the present inventor has been explained above in detail based on the embodiment. However, the present invention is not limited to the above described embodiment, and it goes without saying that various modifications can be made within a range not departing from the gist thereof.

For example, in the above described embodiment, the upper-edge annular part 13*a*1, which forms the annular opening of the ground main-body part 13*a*, is extending so as to be bent in a curved shape toward the inner side in the radial direction of the annular shape. However, a configuration in which it is formed so as to extend to the outer side can be also employed.

As described above, the present invention can be widely applied to various coaxial electrical connectors and coaxial electrical connector devices used in various electronic/electric devices.

What is claimed is:

1. A coaxial electrical connector having an annular contact formed so as to have an annular shape, the coaxial electrical connector configured so that an opposing connector is mated or removed therewith/therefrom along an axial direction of an annular opening, through the annular opening, the annular opening being formed in a ground main-body part of the annular contact, the ground main-body part being provided with a connection leg part configured to be placed on and solder-joined with a printed wiring board, wherein:

the ground main-body part of the annular contact is formed of an unruptured annular member integrally continued in a circumferential direction at a portion between the annular opening and the connection leg part of the ground main-body part;

a plurality of through holes are formed between the annular opening and the connection leg part of the ground main-body part of the annular contact at an approximately equal interval in the circumferential direction; and an annular portion which forms the annular opening extends in a curved shape toward an inner side or an outer side in a radial direction of the annular opening.

2. A coaxial electrical connector device comprising the coaxial electrical connector according to claim 1 and the printed wiring board on which the coaxial electrical connector is mounted, wherein:

the annular contact of the coaxial electrical connector is a ground contact;

a signal contact is disposed in an inner side in a radial direction of the ground contact;

an electrically-conductive ground path to be connected to the ground contact and an electrically-conductive signal path to be connected to the signal contact are formed on the printed wiring board; and the electrically-conductive signal path is formed in a center region of the radial direction of the ground contact.

3. The coaxial electrical connector according to claim 1, wherein the plurality of through holes disperse stress generated in the annular opening.

* * * * *